US009449554B2

(12) United States Patent
Ma

(10) Patent No.: US 9,449,554 B2
(45) Date of Patent: Sep. 20, 2016

(54) PIXEL DRIVING CIRCUIT AND DRIVING METHOD THEREOF, DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/445,290

(22) Filed: Jul. 29, 2014

(65) Prior Publication Data

US 2015/0269885 A1 Sep. 24, 2015

(30) Foreign Application Priority Data

Mar. 24, 2014 (CN) ..... 2014 1 0109585

(51) Int. Cl.
*G09G 3/00* (2006.01)
*G09G 3/32* (2016.01)

(52) U.S. Cl.
CPC .... *G09G 3/3233* (2013.01); *G09G 2300/0819* (2013.01); *G09G 2300/0842* (2013.01); *G09G 2300/0861* (2013.01); *G09G 2320/0233* (2013.01)

(58) Field of Classification Search
CPC ..... G09G 3/36; G09G 5/00; G09G 3/3233; G09G 2300/0861; G09G 3/3291; G09G 2300/0852
See application file for complete search history.

(56) References Cited

U.S. PATENT DOCUMENTS 8,717,273 B2 * 5/2014 Hachida ..... G09G 3/3659 345/98
2004/0066360 A1 * 4/2004 Tobita ..... G09G 3/3258 345/87

* cited by examiner

*Primary Examiner* — Michael Faragalla
(74) *Attorney, Agent, or Firm* — Nath, Goldberg & Meyer; Joshua B. Goldberg

(57) ABSTRACT

The present invention provides a pixel driving circuit and a driving method thereof, and a display apparatus. The pixel driving circuit comprises a reset module, a data write module, an output module and a potential holding module, wherein the potential holding module is used for holding potential of a control node when a signal is inputted from an emission signal input terminal. With this pixel driving circuit, the potential of a gate of a driving transistor is prevented from being influenced by the current leakage, and holding effect of potential of the gate of the driving transistor is improved.

9 Claims, 3 Drawing Sheets

PIXEL DRIVING CIRCUIT AND DRIVING METHOD THEREOF, DISPLAY APPARATUS

FIELD OF THE INVENTION

The present invention relates to a field of display driving circuit technology, and in particular, relates to a pixel driving circuit and a driving method thereof, and a display apparatus.

BACKGROUND OF THE INVENTION

An organic light emitting diode (OLED) is a current-mode light emitting device. Due to advantages such as spontaneous light emitting, fast response, wide-viewing angle and ability to be fabricated on a flexible substrate, the OLED is more frequently used in a field of high performance display. OLEDs can be classified into two kinds of passive matrix driving OLEDs (PMOLEDs) and active matrix driving OLEDs (AMOLEDs) based on driving modes thereof. With respect to traditional PMOLEDs, with increasing of size of a display apparatus, a driving time of a single pixel is usually required to be reduced, thus a transient current flowing through a PMOLED is required to be increased, and thereby power consumption will be increased significantly. In contrast, with respect to AMOLEDs, as a current is inputted into each OLED by progressive scanning of a thin film transistor (TFT) switching circuit, existing problems can be well solved.

In an existing AMOLED pixel driving circuit, voltage of a gate of a driving transistor during a light emitting stage can be held in three ways. The first way is to improve current leakage property of transistors, that is, to reduce current leakage of transistors. The second way is to use a design of a pair of transistors so as to be connected with the gate of the driving transistor. The third way is to increase the capacitance of a storage capacitor (C). A present AMOLED pixel driving circuit usually employs the three ways as above.

Specifically, FIG. 1 shows a configuration of an AMOLED pixel driving circuit commonly used in current market. In this pixel driving circuit, in order to suppress outflow of charges from a gate of a driving transistor M8 during a light emitting stage, capacitance of a storage capacitor C is increased, and a pair of transistors are used to connected with the gate of the driving transistor M8, that is, transistors M1 and M2 are formed as a pair of transistors, and transistors M3 and M4 are formed as a pair of transistors. In this way, during the light emitting stage of the AMOLED, potential of the gate of the driving transistor M8 is unchanged, and light emitting is stabilized. The operational principle of the pixel driving circuit is briefly described as follows. The pixel driving circuit operates in three stages. A first stage is a reset stage, in which a signal of Vref is effective, and the transistors M1 and M2 are turned on, thus potential between the storage capacitor and the gate of the driving transistor M8 is reset by a signal of Vin through the transistors M1 and M2. A second stage is a data write stage, in which the signal of Vref becomes ineffective, an effective signal is inputted through a gate line Gate, and a data signal Data is inputted to a source of the transistor M8 through a transistor M5, then the transistors M3 and M4 are turned on so that the gate and a drain of the transistor M8 are connected with each other, that is, the transistor M8 functions as a diode, thus a signal Data+Vth is written to the gate of the transistor M8, that is, is written into the storage capacitor C to be held by the capacitor, wherein Vth is a threshold voltage of the transistor M8. A third stage is a light emitting stage, in which both of Vref and Gate become ineffective, and an effective signal is inputted from a emission signal input terminal Em, thus transistors M6, M7 and M8 are turned on, thereby an organic light emitting diode D emits light, then when potential of the gate of the transistor M8 is constant, the organic light emitting diode D emits light stably, at this time, potential of the gate of the transistor M8 is held by the storage capacitor C and the pair transistors M1, M2 and M3, M4.

In this configuration, the larger the capacitance of the storage capacitor C is, the better the potential of the gate of the driving transistor M8 is maintained. However, in a high resolution product, size of a pixel is smaller and smaller, resulting that the storage capacitor will not be large, which will directly affect potential holding effect.

SUMMARY OF THE INVENTION

The present invention provides a pixel driving circuit and a driving method thereof, and a display apparatus, which can prevent the current leakage from influencing the potential of a gate of a driving transistor in a pixel driving circuit, and improve holding effect of potential of the gate of the driving transistor in the pixel driving circuit.

To achieve the objective as above, following technical solutions are employed.

In an aspect of the present invention, a pixel driving circuit is provided. The pixel driving circuit comprises a reset module, a data write module, an output module and a potential holding module, wherein the reset module is connected to a reset signal input terminal, a reset voltage and a control node, and is used for resetting potential of the control node in accordance with a signal inputted from the reset signal input terminal; the data write module is connected to a gate line, a data input terminal, the control node and the output module, and is used for storing a data signal inputted from the data input terminal to the control node as a voltage when a row driving signal is inputted through the gate line, and the voltage stored at the control node is used for activating the output module; the output module is also connected to an emission signal input terminal, the control node and a light emitting device, and is used for supplying power to the light emitting device when a signal is inputted from the emission signal input terminal; and the potential holding module is connected to the emission signal input terminal, the reset module and the data write module, and is used for holding the potential of the control node when a signal is inputted from the emission signal input terminal.

The present invention also provides a display apparatus comprising the pixel driving circuit as above.

Further, the present invention provides a driving method of the pixel driving circuit as above. The driving method comprises: the reset module resets potential of the control node in accordance with a signal inputted from the reset signal input terminal; when a row driving signal is inputted through the gate line, the data write module stores a data signal inputted from the data input terminal to the control node as a voltage, and the voltage stored at the control node is used for activating the output module; and when a signal is inputted from the emission signal input terminal, the output module supplies power to the light emitting device, and the potential of the control node is held by the potential holding module.

With the pixel driving circuit and the driving method thereof, and the display apparatus provided by the invention, by holding potential of the gate of the driving transistor in the pixel driving circuit through the potential holding module, the potential of the gate of the driving transistor in the pixel driving circuit is prevented from being influenced by the current leakage, and the potential of the gate of the driving transistor in the pixel driving circuit is kept constant during the light emitting stage of the light emitting device, thus holding effect of the potential of the gate of the driving transistor in the pixel driving circuit is improved. Meanwhile, there is no need for a storage capacitor, so that space for pixels is increased effectively, and the pixel driving circuit may be used in a high resolution product.

BRIEF DESCRIPTION OF THE DRAWINGS

To more clearly explain technical solutions of the present invention or the prior art, drawings required to be used in description of embodiments of the present invention or in description of the prior art will be introduced simply below. Obviously, the drawings described below are only for illustrating some embodiments of the present invention, and other drawings can be obtained according to these drawings by persons skilled in the art without any creative work. In the drawings.

DETAILED DESCRIPTION OF THE INVENTION

Figure 1:
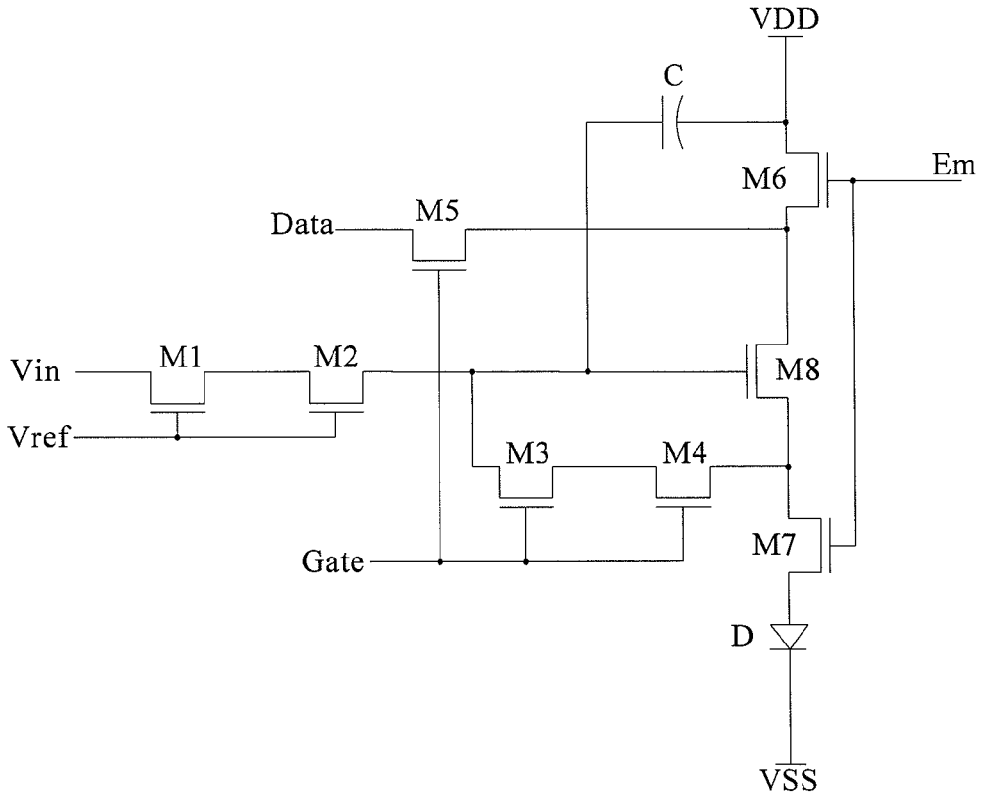
FIG. 1 is a circuit diagram of a pixel driving circuit of the prior art.

Technical solutions of the embodiments of the present invention will be described in a clear and complete manner in conjunction with the drawings. Apparently, described embodiments are only some of the embodiments of the present invention rather than all embodiments. Based on the descried embodiments, all other embodiments obtained by persons skilled in the art without creative work are intended to be encompassed by protection scope of the present invention.

Transistors used in embodiments of the present invention may be thin film transistors, field effect transistors or other devices with the same characteristics. As a source and a drain of a transistor used here are symmetrical, there is no difference therebetween. In the embodiments of the present invention, in order to distinguish other two electrodes except for a gate of a transistor, a source of a transistor is referred to as a first electrode, and a drain of a transistor is referred to as a second electrode. In accordance with the forms of the transistors in the drawings, a middle terminal of a transistor is referred to as a gate of the transistor, a signal input terminal of a transistor is referred to as a source of the transistor, and a signal output terminal of a transistor is referred to as a drain of the transistor. Further, in accordance with characteristics of transistors, transistors can be classified into N-type and P-type. In the embodiments of the present invention, as an example, all transistors are P-type transistors. A characteristic of the P-type transistor is that, when a low voltage is inputted into the gate of the transistor, the transistor is turned on. It should be understand that, it is readily conceivable to a person skilled in the art without creative work to use N-type transistors to implement embodiments of the present invention, thus embodiments in which N-type transistors are used are intended to be encompassed by protection scope of the present invention.

Figure 2:
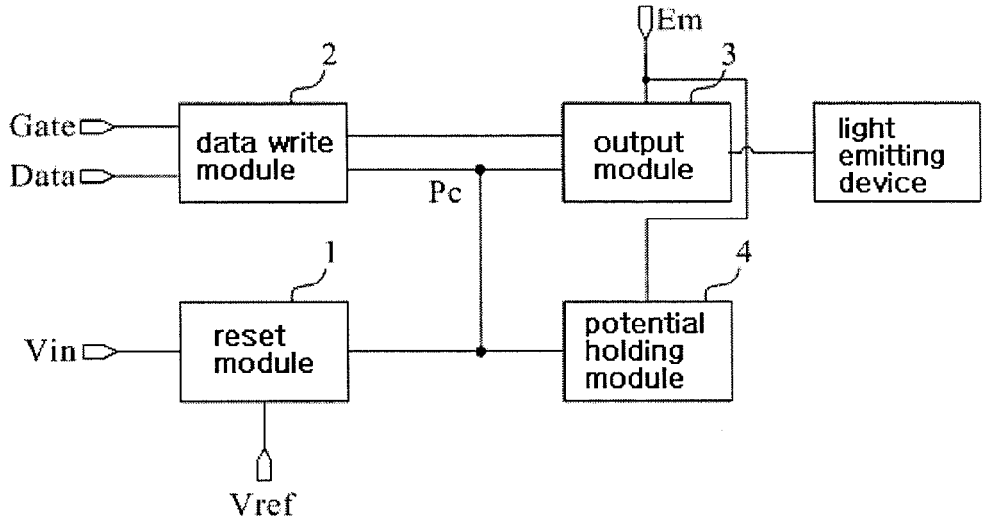
FIG. 2 is a block diagram of the pixel driving circuit according to an embodiment of the present invention.

FIG. 2 shows a pixel driving circuit according to an embodiment of the present invention. As shown in FIG. 2, the pixel driving circuit comprises a reset module 1, a data write module 2, an output module 3 and a potential holding module 4.

The reset module 1 is connected to a reset signal input terminal Vref, a reset voltage Vin and a control node Pc, and is used for resetting potential of the control node Pc in accordance with a signal inputted from the reset signal input terminal Vref.

The data write module 2 is connected to a gate line Gate, a data input terminal Data, the control node Pc and the output module 3, and is used for storing a data signal inputted from the data input terminal Data to the control node Pc as a voltage when a row driving (scanning) signal is inputted through the gate line Gate, and the voltage stored at the control node Pc is used for activating the output module 3.

The output module 3 is also connected to an emission signal input terminal Em, the control node Pc and a light emitting device D, and is used for supplying power to the light emitting device D when a signal is inputted from the emission signal input terminal Em.

The potential holding module 4 is connected to the emission signal input terminal Em, the reset module 1 and the data write module 2, and is used for holding potential of the control node Pc when a signal is inputted from the emission signal input terminal Em.

In the pixel driving circuit of the embodiment of the present invention, with the potential holding module, the potential of the gate of the driving transistor in the pixel driving circuit is prevented from being influenced by the current leakage, and the potential of the gate of the driving transistor in the pixel driving circuit is kept constant during the light emitting stage of the light emitting device D, thus holding effect of potential of the gate of the driving transistor in the pixel driving circuit is improved. Meanwhile, there is no need for a storage capacitor, so that space for pixels is increased, and the pixel driving circuit may be used in a high resolution product.

It should be noted that, in the embodiment of the present invention, the reset voltage Vin may be always a low voltage signal for pulling down the level of the control node Pc when the reset module 1 is activated. R, G and B signals from the DEMUX are inputted into the data input terminal Data. The light emitting device in the embodiment of the present invention may be any current driven light emitting device of the prior art such as LED or OLED.

Figure 3:
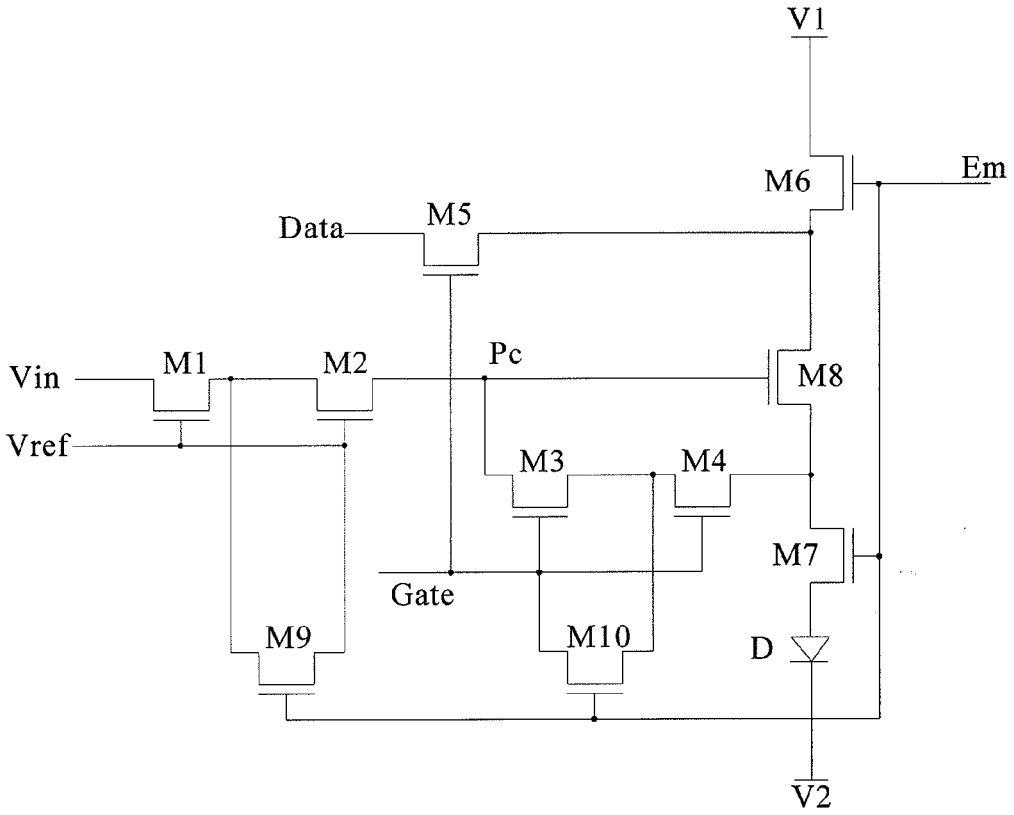
FIG. 3 is a circuit diagram of a pixel driving circuit according to an embodiment of the present invention.

Further, as shown in FIG. 3, the reset module 1 may comprise: a first transistor M1, wherein a first electrode of the first transistor M1 is connected to the reset voltage Vin, a gate of the first transistor M1 is connected to the reset signal input terminal Vref; and a second transistor M2, wherein a first electrode of the second transistor M2 is connected to a second electrode of the first transistor M1, and a gate of the second transistor M2 is connected to the reset signal input terminal Vref, and a second electrode of the second transistor M2 is connected to the control node Pc.

In such manner, under the control of the reset signal input terminal Vref, the first transistor M1 and the second transistor M2 are turned on at the same time, thus the reset voltage Vin is outputted to the control node Pc, thereby the level of the control node Pc is pulled down, and a reset function is achieved. In addition, with such a design of a pair of transistors (M1 and M2), potential of the control node Pc is relatively stable during light emitting of the light emitting device D, and the light emitting device D emits light stably.

Further, as shown in FIG. 3, the data write module 2 comprises: a third transistor M3, wherein a gate of the third transistor M3 is connected to the gate line Gate, and a second electrode of the third transistor M3 is connected to the control node Pc; a fourth transistor M4, wherein a first electrode of the fourth transistor M4 is connected to the output module 3, a gate of the fourth transistor M4 is connected to the gate line Gate, and a second electrode of the fourth transistor M4 is connected to a first electrode of the third transistor M3; and a fifth transistor M5, wherein a first electrode of the fifth transistor M5 is connected to the data input terminal Data, a gate of the fifth transistor M5 is connected to the gate line Gate, and a second electrode of the fifth transistor M5 is connected to the output module 3.

When a row driving signal is inputted through the gate line Gate, the transistors M3, M4 and M5 are turned on, thus RGB signals from the data input terminal Data are inputted into the output module 3. Similar to the reset module 1, with a design of a pair of transistors (M3 and M4), the potential of the control node Pc is relatively stable during light emitting of the light emitting device D, thus the light emitting device D emits light stably.

Further, as shown in FIG. 3, the output module 3 comprises: a sixth transistor M6, wherein a first electrode of the sixth transistor M6 is connected to a first voltage terminal V1, a gate of the sixth transistor M6 is connected to the emission signal input terminal Em, and a second electrode of the sixth transistor M6 is connected to the second electrode of the fifth transistor M5; a seventh transistor M7, wherein a first electrode of the seventh transistor M7 is connected to the first electrode of the fourth transistor M4, a gate of the seventh transistor M7 is connected to the emission signal input terminal Em, and a second electrode of the seventh transistor M7 is connected to the light emitting device D; and an eighth transistor M8, wherein a first electrode of the eighth transistor M8 is connected to the second electrode of the sixth transistor M6, a gate of the eighth transistor M8 is connected the control node Pc, and a second electrode of the eighth transistor M8 is connected to the first electrode of the seventh transistor M7.

In the embodiment of the present invention, an example in which P-type transistors are used is given. Here, a high voltage VDD is inputted into the first voltage terminal V1.

Specifically, when a row driving signal is inputted through the gate line Gate, RGB signals from the data input terminal Data are inputted into the first electrode of the transistor M8, then a signal Data+Vth is inputted into the gate of the transistor M8 via the transistor M8, wherein Vth is a threshold voltage of the transistor M8. When an effective signal is inputted into the emission signal input terminal Em, the transistors M6 and M7 are turned on, so that the signal on the gate of the transistor M8 is maintained, and the transistor M6 is always turned on during light emitting stage of the light emitting device D, emitted light compensation is achieved.

Further, as shown in FIG. 3, the potential holding module 4 comprises: a ninth transistor M9, wherein a first electrode of the ninth transistor M9 is connected to the first electrode of the second transistor M2, a gate of the ninth transistor M9 is connected to the emission signal input terminal Em, and a second electrode of the ninth transistor M9 is connected to the gate of the second transistor M2; and a tenth transistor M10, wherein a first electrode of the tenth transistor M10 is connected to the gate of the third transistor M3, a gate of the tenth transistor M10 is connected to the emission signal input terminal Em, and a second electrode of the tenth transistor M10 is connected to the first electrode of the third transistor M3.

In such manner, when an effective signal is inputted from the emission signal input terminal Em, all of the transistors M6, M7, M8, M9 and M10 are turned on. when the transistor M9 is turned on, the gate (which is at a high potential of Vref) and the source of the transistor M2 are connected with each other, thus the transistor M2 functions as a diode. As both of the gate and the source of the transistor M2 are at a high potential, and this potential is higher than potential of the gate of the transistor M8 (that is, the potential of the control node Pc), in accordance with principle of a diode (being conducting in a single direction), the potential of the gate of the transistor M8 will not be lowered by the transistor M2. Based on the same reason, when the transistor M10 is turned on, the gate (which is at a high potential) and the source of the transistor M3 are connected with each other, thus the transistor M3 functions as a diode. As both of the gate and the source of the transistor M3 are at a high potential, and this potential is higher than that of the gate of the transistor M8, in accordance with principle of a diode (being conducting in a single direction), the potential of the gate of the transistor M8 will not be lowered by the transistor M3. Thus, the potential of the gate of the transistor M8 will be held during entire light emitting stage of the light emitting device D. Meanwhile, transistors M6, M7 and M8 are turned on, so that the light emitting device D emits light stably.

In the pixel driving circuit as shown in FIG. 3, one terminal of the light emitting device D is connected to the second electrode of the seventh transistor M7, the other terminal of the light emitting device D is connected to a second voltage terminal V2, wherein as an example, all of the transistors are P-type transistors, and a low voltage VSS is inputted into the second voltage terminal V2.

This configuration of the pixel driving circuit can prevent the current leakage from influencing the potential of the gate of the driving transistor M8, and ensure a constant potential of the gate of the driving transistor M8 during light emitting stage of the light emitting device D, thus the holding effect of potential of the gate of the driving transistor is improved.

In the pixel driving circuit as shown in FIG. 3, only ten P-type transistors are contained, and there is no capacitor. Thus, a relatively small number of components are used, facilitating designing and manufacturing. In addition, as there is no need for a storage capacitor, space for pixels is increased, and the pixel driving circuit may be used in a high resolution product.

Figure 4:
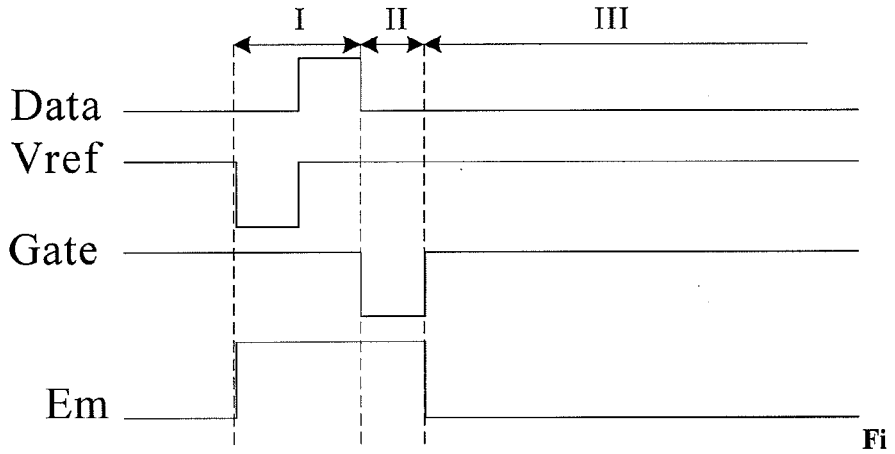
FIG. 4 is a timing diagram of driving signals of the pixel driving circuit shown in FIG. 3.

FIG. 4 shows a timing diagram of driving signals of the pixel driving circuit. Driving principle of the pixel driving circuit according to the embodiment of the present invention will be described in detail in a manner that the working of the pixel driving circuit is divided into three stages. In the embodiment of the present invention, a high level VDD is inputted into the first voltage signal terminal V1, and a low level VSS is inputted into the second voltage signal terminal V2.

A first stage is a reset stage. In this stage, an effective signal (a low level as shown in FIG. 4) is inputted from the reset signal input terminal Vref, so that the transistors M1 and M2 are turned on, thus the reset voltage Vin makes potential of the gate of the driving transistor M8 reset through the transistors M6 and M7.

A second stage is a data write stage, in which the reset signal input terminal Vref is ineffective (being a high level as shown in FIG. 4), an effective signal (a low level as shown in FIG. 4) is inputted through the gate line Gate, and a data signal Data is inputted to the source of the transistor M8 via the transistor M5. In addition, when the transistors M3 and M4 are turned on, the gate and the drain of the transistor M8 are connected with each other, thus the transistor M8 functions as a diode, so that a signal Data+Vth is written into the gate of the transistor M8, wherein Vth is a threshold voltage of the transistor M8.

A third stage is a light emitting stage, in which there is no effective signal outputted from the reset signal input terminal Vref and the gate line Gate, and only the emission signal input terminal Em outputs an effective signal (a low level as shown in FIG. 4), thus all of the transistors M6, M7, M8, M9 and M10 are turned on. When the transistor M9 is turned on, the gate (a high potential of Vref) and the source of the transistor M2 are connected with each other, thus the transistor M2 functions as a diode. As both of the gate and the source of the transistor M2 are at a high potential, and this potential is higher than that of the gate of the transistor M8 (that is, potential of the control node Pc), in accordance with principle of a diode (being conducting in a single direction), the potential of the gate of the transistor M8 will not be lowered by the transistor M2. Based on the same reason, when the transistor M10 is turned on, the gate (which is at a high potential) and the source of the transistor M3 are connected with each other, thus the transistor M3 functions as a diode. As both of the gate and the source of the transistor M3 are at a high potential, and this potential is higher than that of the gate of the transistor M8, in accordance with principle of a diode (being conducting in a single direction), the potential of the gate of the transistor M8 will not be lowered by the transistor M3. Thus, the potential of the gate of the transistor M8 will be held during entire light emitting stage of the light emitting device D. Meanwhile, the transistors M6, M7 and M8 are turned on, so that the light emitting device D emits light stably.

It should be noted that, in the pixel driving circuit of the embodiment of the present invention, the transistors T1 to T8 are illustrated as P-type transistors, which is only an example. The timing diagram of the driving signal of the pixel driving circuit may be shown as in FIG. 4.

When all of the transistors T1 to T8 are N-type transistors, the driving signals are reversed to achieve the same function as above. The specific driving principle in this case may be referred to the descriptions of the above stages, which will not be explained repeatedly here.

Another embodiment of the present invention provides a display apparatus comprising an organic light emitting display or any other display. The display apparatus comprises any of the pixel driving circuits mentioned above. The display apparatus may comprise a plurality of pixel units, and each pixel unit comprises the pixel driving circuit mentioned above.

Specifically, the display apparatus according to the embodiment of the present invention may be a display apparatus having a current driven light emitting device, such as a LED display or an OLED display.

The display apparatus according to the embodiment of the present invention comprises the pixel driving circuit as above. With the potential holding module, the potential of the gate of the driving transistor in the pixel driving circuit is prevented from being influenced by the current leakage, and the potential of the gate of the driving transistor in the pixel driving circuit is kept constant during the light emitting stage of the light emitting device D, thus the holding effect of the potential of the gate of the driving transistor in the pixel driving circuit is improved. Meanwhile, there is no need for a storage capacitor, so that space for pixels is increased effectively, and the pixel driving circuit may be used in a high resolution product.

Figure 5:
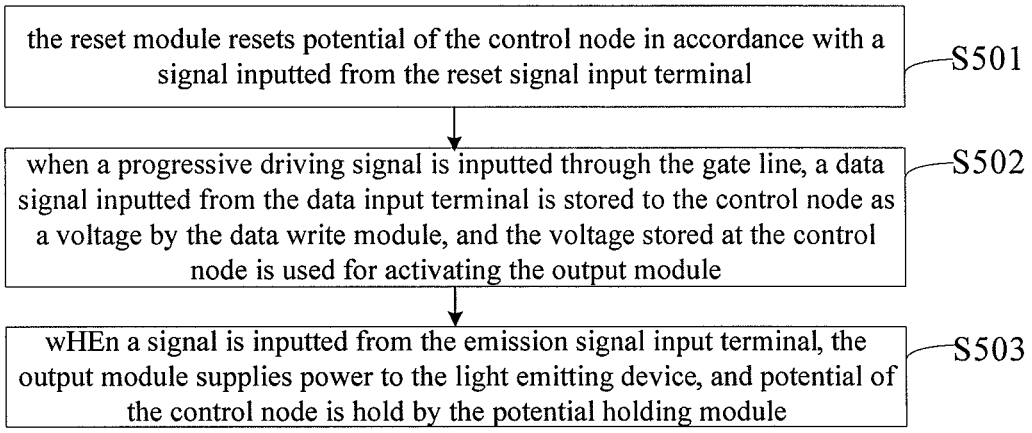
FIG. 5 is a flow chart of a driving method of an pixel driving circuit according to an embodiment of the present invention.

A driving method of a pixel driving circuit of the invention may be applied to the pixel driving circuits according to the above embodiments of the invention. As shown in FIG. 5, the driving method of the pixel driving circuit comprises: at S501, the reset module resets potential of the control node in accordance with a signal inputted from the reset signal input terminal; at S502, when a row driving signal is inputted through the gate line, a data signal inputted from the data input terminal is stored to the control node as a voltage by the data write module, and the voltage stored at the control node is used for activating the output module; and at S503, when a signal is inputted from the emission signal input terminal, the output module supplies power to the light emitting device, and the potential of the control node is hold by the potential holding module.

According to the driving method of the pixel driving circuit of the invention, by holding the potential of the control node with the potential holding module, the potential of the gate of the driving transistor in the pixel driving circuit is prevented from being influenced by the current leakage, and the potential of the gate of the driving transistor in the pixel driving circuit is kept constant during the light emitting stage of the light emitting device D, thus the holding effect of the potential of the gate of the driving transistor in the pixel driving circuit is improved. Meanwhile, there is no need for a storage capacitor, so that space for pixels is increased effectively, and the pixel driving circuit may be used in a high resolution product.

It should be noted that, the light emitting device in the embodiment of the present invention may be any current driven light emitting device of the prior art, such as LED or OLED.

In the embodiment of the present invention, all of the transistors in the pixel driving circuit may be P-type transistors or N-type transistors.

When the transistors in the pixel driving circuit are P-type transistors, a first electrode of each transistor is a source of the transistor, and a second electrode of each transistor is a drain of the transistor.

Further, when the transistors in the pixel driving circuit are P-type transistors, as shown in FIG. 4, timing of the control signals comprises the following stages.

In a first stage, a frame of low level and a frame of high level are successively inputted into both of the data input terminal Data and the reset signal input terminal Vref, and a high level is inputted into the gate line Gate and the emission signal input terminal Em.

In a second stage, a low level is inputted into the data input terminal Data and the gate line Gate, and a high level is inputted into the reset signal input terminal Vref and the emission signal input terminal Em.

In a third stage, a low level is inputted into the data input terminal Data and the emission signal input terminal Em, and a high level is inputted into the reset signal input terminal Vref and the gate line Gate.

It should be noted that, in the driving method of the pixel driving circuit according to the embodiment of the present invention, as an example, all of the transistors in the pixel driving circuit are P-type transistors, thus the timing diagram of the driving signals in the driving method of the pixel driving circuit is as shown in FIG. 4.

When all of the transistors in the pixel driving circuit are N-type transistors, the driving signals are reversed to achieve the same function as above. The specific driving principle in this case may be referred to descriptions of the above stages, which will not be explained repeatedly here.

Skilled persons in the art should understand that, all or part of the embodiments described above may be implemented by hardware related to computer program, and the computer program may be stored in a computer readable storage medium such as ROM, RAM, magnetic disk, optical disk, or any other medium capable of storing the computer program, wherein when the computer program is executed, a method comprising steps of the embodiments described above is performed.

Only some specific embodiments of the present invention are described above, but protection scope of the present invention is not limited thereto. Any alteration or substitution that is readily conceivable to those skilled in the art within technical scope of disclosure of the present invention is intended to be encompassed by protection scope of the present invention. Protection scope of the claims should prevail over protection scope of the present invention.

The invention claimed is:

1. A pixel driving circuit, characterized in that, it comprises a reset module, a data write module, an output module and a potential holding module, wherein the reset module is connected to a reset signal input terminal, a reset voltage and a control node, and is used for resetting potential of the control node in accordance with a signal inputted from the reset signal input terminal, the data write module is connected to a gate line, a data input terminal, the control node and the output module, and is used for storing a data signal inputted from the data input terminal to the control node as a voltage when a row driving signal is inputted through the gate line, and the voltage stored at the control node is used for activating the output module, the output module is also connected to an emission signal input terminal, the control node and a light emitting device, and is used for supplying power to the light emitting device when a signal is inputted from the emission signal input terminal, and the potential holding module is connected to the emission signal input terminal, the reset module and the data write module, and is used for holding potential of the control node when a signal is inputted from the emission signal input terminal; and the reset module further comprises:

a first transistor, wherein a first electrode of the first transistor is connected to the reset voltage, a gate of the first transistor is connected to the reset signal input terminal; and a second transistor, wherein a first electrode of the second transistor is connected to a second electrode of the first transistor, a gate of the second transistor is connected to the reset signal input terminal, and a second electrode of the second transistor is connected to the control node.

2. The pixel driving circuit of claim 1, characterized in that, the data write module comprises:

a third transistor, wherein a gate of the third transistor is connected to the gate line, and a second electrode of the third transistor is connected to the control node;

a fourth transistor, wherein a first electrode of the fourth transistor is connected to the output module, a gate of the fourth transistor is connected to the gate line, and a second electrode of the fourth transistor is connected to a first electrode of the third transistor; and a fifth transistor, wherein a first electrode of the fifth transistor is connected to the data input terminal, a gate of the fifth transistor is connected to the gate line, and a second electrode of the fifth transistor is connected to the output module.

3. The pixel driving circuit of claim 2, characterized in that, the output module comprises:

a sixth transistor, wherein a first electrode of the sixth transistor is connected to a first voltage terminal, a gate of the sixth transistor is connected to the emission signal input terminal, and a second electrode of the sixth transistor is connected to the second electrode of the fifth transistor;

a seventh transistor, wherein a first electrode of the seventh transistor is connected to the first electrode of the fourth transistor, a gate of the seventh transistor is connected to the emission signal input terminal, and a second electrode of the seventh transistor is connected to the light emitting device; and an eighth transistor, wherein a first electrode of the eighth transistor is connected to the second electrode of the sixth transistor, a gate of the eighth transistor is connected the control node, and a second electrode of the eighth transistor is connected to the first electrode of the seventh transistor.

4. The pixel driving circuit of claim 3, characterized in that, the potential holding module comprises:

a ninth transistor, wherein a first electrode of the ninth transistor is connected to the first electrode of the second transistor, a gate of the ninth transistor is connected to the emission signal input terminal, and a second of the ninth transistor is connected to the gate of the second transistor; and an tenth transistor, wherein a first electrode of the tenth transistor is connected to the gate of the third transistor, a gate of the tenth transistor is connected to the emission signal input, and a second electrode of the tenth transistor is connected to the first electrode of the third transistor.

5. The pixel driving circuit of claim 3, characterized in that, one terminal of the light emitting device is connected to the second electrode of the seventh transistor, and the other terminal of the light emitting device is connected to a second voltage terminal.

6. The pixel driving circuit of claim 4, characterized in that, all of the transistors are P-type transistors or N-type transistors, when the transistors are P-type transistors, the first electrode of each transistor is a source of the transistor, and the second electrode of each transistor is a drain of the transistor.

7. A display apparatus, characterized in that, it comprises the pixel driving circuit of claim 1.

8. A driving method of a pixel driving circuit, wherein the pixel driving circuit comprises a reset module, a data write module, an output module and a potential holding module, wherein the reset module is connected to a reset signal input terminal, a reset voltage and a control node, and is used for resetting potential of the control node in accordance with a signal inputted from the reset signal input terminal, the data write module is connected to a gate line, a data input terminal, the control node and the output module, and is used for storing a data signal inputted from the data input terminal to the control node as a voltage when a row driving signal is inputted through the gate line, and the voltage stored at the control node is used for activating the output module, the output module is also connected to an emission signal input terminal, the control node and a light emitting device, and is used for supplying power to the light emitting device when a signal is inputted from the emission signal input terminal, and the potential holding module is connected to the emission signal input terminal, the reset module and the data write module, and is used for holding potential of the control node when a signal is inputted from the emission signal input terminal;

the driving method characterized in that, it comprises:

the reset module resets potential of the control node in accordance with a signal inputted from the reset signal input terminal;

when a row driving signal is inputted through the gate line, a data signal inputted from the data input terminal is stored to the control node as a voltage by the data write module, and the voltage stored at the control node is used for activating the output module; and when a signal is inputted from the emission signal input terminal, the output module supplies power to the light emitting device, and potential of the control node is held by the potential holding module.

9. The driving method of claim 8, characterized in that, when all of the transistors in the pixel driving circuit are P-type transistors, drive timing of the driving method comprises:

a first stage, in which a low level and a high level are successively inputted into both of the data input terminal and the reset signal input terminal, and a high level is inputted into the gate line and the emission signal input terminal, a second stage, in which a low level is inputted into the data input terminal and the gate line, and a high level is inputted into the reset signal input terminal and the emission signal input terminal, and a third stage, in which a low level is inputted into the data input terminal and the emission signal input terminal, and a high level is inputted into the reset signal input terminal and the gate line.

* * * * *